US006961227B1

(12) United States Patent
Whiton et al.

(10) Patent No.: US 6,961,227 B1
(45) Date of Patent: Nov. 1, 2005

(54) ELECTRICALLY CHARGED SELF-DEFENSE WEARABLE

(76) Inventors: Adam Whiton, 750 Tremont St., #6, Boston, MA (US) 02118; Yolita Nugent, 47 Gretter Rd., Boston, MA (US) 02132

( * ) Notice: Subject to any disclaimer, the term of this patent is extended or adjusted under 35 U.S.C. 154(b) by 418 days.

(21) Appl. No.: 10/294,103

(22) Filed: Nov. 13, 2002

Related U.S. Application Data

(60) Provisional application No. 60/350,717, filed on Nov. 13, 2001.

(51) Int. Cl.[7] ..... H02H 23/00
(52) U.S. Cl. ..... 361/232
(58) Field of Search ..... 361/232

(56) References Cited

U.S. PATENT DOCUMENTS

| | | | | |
|---|---|---|---|---|
| 1,915,721 | A * | 6/1933 | Diaz | 361/232 |
| 2,155,331 | A * | 4/1939 | Sadloski | 405/186 |
| 3,819,108 | A | 6/1974 | Jordan | |
| 4,337,496 | A | 6/1982 | Laird | |
| 4,370,696 | A * | 1/1983 | Darrell | 361/232 |
| 4,485,426 | A | 11/1984 | Kerls | |
| 4,753,088 | A | 6/1988 | Harrison et al. | |
| 5,158,039 | A | 10/1992 | Clark | |
| 5,802,607 | A | 9/1998 | Triplette | |
| 5,906,004 | A | 5/1999 | Lebby et al. | |
| 6,210,771 | B1 | 4/2001 | Post et al. | |

* cited by examiner

*Primary Examiner*—Ronald Leja
(74) *Attorney, Agent, or Firm*—O'Connell Law Firm

(57) ABSTRACT

A self-defense wearable with a body portion, an electrically conductive pathway applied over the body portion, an electrically charged seam construction for producing an electric charge relative to an outer surface of the body portion, a power source, an activating switch for inducing the self-defense wearable into a charged condition, and a wiring network for producing an electrical association between the electrically conductive pathway, the power source, and the at least one activating switch. The self-defense wearable can be an upper body covering, and the activating switch can be a compression activated switch disposed on a tongue disposed at a distal end of an arm of the self-defense wearable to underlie the wearer's palm whereby the self-defense wearable can be induced into a charged condition by a clenching of the wearer's hand.

49 Claims, 8 Drawing Sheets

ELECTRICALLY CHARGED SELF-DEFENSE WEARABLE

PRIORITY INFORMATION

This application claims priority to U.S. Provisional Patent Application No. 60/350,717, filed Nov. 13, 2001.

FIELD OF THE INVENTION

The present invention relates generally to articles of apparel. Stated more particularly, this patent discloses and protects a wearable that provides safety and security to a wearer by enabling the wearer to administer or threaten an electrical charge to a hostile person.

BACKGROUND OF THE INVENTION

It is an unfortunate reality that three out of every four American women will fall victim to at least one violent crime during their lifetime. As a result, it is clear that there is a need for systems and methods for providing women with security. While a plurality of such systems and methods have been disclosed, even the combined prior art continues to suffer from a number of shortcomings that have prevented the arrangements of the prior art from achieving widespread success and usage. As a result, most such systems and methods of the prior art have remained primarily theoretical in nature. As a result, they have represented little actual improvement in the safety of women.

For example, many prior art self-protection devices for women are of dubious effectiveness. Other arrangements can additionally or alternatively present a danger to the female user in that the device that was intended to defend the woman could be converted into a weapon against her. In a still further shortcoming, many prior art devices demand that the woman brandish a hand-held device or its equivalent. As such, they require acts of aggression on the part of the user thereby rendering them unappealing to many users, particularly females. For these and further reasons, it is apparent that the conception and design of most prior art self-protection devices fail to accommodate the special and different needs of female users.

In any event, one knowledgeable in the art will be aware that a number of self-defense apparatuses, including some intended to be worn by the user, have sought to protect the user by enabling him or her to inflict an electrical charge on a hostile party. Exacting an electrical shock on an assailant at a suitable level certainly can be an appropriate and effective non-lethal means for confronting attacks on one's person. However, providing an electrically charged wearable that can exact such a shock has presented inventors of the prior art with a plurality of significant challenges that have been left substantially unmet.

Most basically, it is clear that the user must be confident that she can induce the electrical charge in a reliable and substantially immediate manner. Just as importantly, for the wearable to be usable in everyday life, it must be ensured that the wearable cannot become armed and charged unintentionally. Still further, to be most effective, it would be preferable if the charge to be exhibited by the wearable could be selectively controlled or calibrated to accommodate varied circumstances.

In light of the foregoing, it will be appreciated that a wearable overcoming one or more of the challenges described above would represent a useful advance in making non-lethal, electrically charged apparel a practical self-defense solution, particularly for female users. It will be further appreciated that an electrically charged wearable that would provide a solution to each of the shortcomings of the prior art while demonstrating a plurality of additional refinements thereover would represent a significant advance in the art.

SUMMARY OF THE INVENTION

Advantageously, the present invention is founded on the basic object of providing a self-defense system that overcomes each of the described disadvantages that have been demonstrated by the prior art while providing a number of heretofore unrealized advantages thereover.

A more particular object of the invention is to provide a wearable that enables the wearer to exact a disabling or discouraging charge upon an assailant immediately and reliably.

A further object of particular embodiments of the invention is to provide an electrically charged wearable that eliminates substantially all risk of inadvertent or unintended arming and charging.

A related object of embodiments of the invention is to provide such an electrically charged wearable that is not likely to pose as a danger to the wearer or to non-hostile parties.

In certain embodiments, yet another object of the invention is to provide an electrically charged wearable that can exact electrical shocks of selectively or automatically varied intensity depending on certain parameters, such as the perceived level of attack and environmental conditions.

Still another object of preferred embodiments of the invention is to provide an electrically charged wearable that can exploit the wearer's instinctive response to an attack to provide immediate self-defense protection.

An even further object of the invention is to provide an electrically charged wearable that can provide adequate self-defense without regard to the strength or psychological state of the wearer.

In particular embodiments, yet another object of the invention is to provide an electrically charged wearable that can apprise a potential attacker of its capacity to shock thereby to discourage attacks altogether.

These and further objects and advantages of the invention will become obvious not only to one who reviews the present specification and drawings but also to one who has an opportunity to make use of an embodiment of the present invention. However, it will be appreciated that, although the accomplishment of each of the foregoing objects in a single embodiment of the invention may be possible and indeed preferred, not all embodiments will seek or need to accomplish each and every potential advantage. Nonetheless, all such embodiments should be considered within the scope of the present invention.

In accomplishing the aforementioned objects, a most basic embodiment of the present invention for a self-defense wearable enables a wearer to exact or threaten an electrical charge on a physical assailant. The self-defense wearable is founded on a body portion that overlies one or more body parts of a wearer. The body portion has an outer surface and an inner surface and is formed of at least one layer of material. An electrically conductive pathway is applied in a given pattern over the at least one layer of material, and a means is associated with the electrically conductive pathway for producing an electric charge capable of being imparted to an entity in contact with or proximity to the outer surface of the body portion. A power source provides electrical power to the electrically conductive pathway, and at least one activating switch can be employed to induce the self-defense wearable into a charged condition wherein an electric charge will be produced. A wiring network achieves an electrical association between the electrically conductive pathway, the power source, the at least one activating switch, and any other electrical components of the self-defense wearable.

In certain embodiments, the self-defense wearable can incorporate an arming device, such as a key switch, a coded keypad, a dial, or any other appropriate arrangement, for arming and disarming the self-defense wearable to enable or disable electrical power transmission between the power source and the electrically conductive pathway. A visual indicator, such as a light emitting diode, can indicate to the wearer and to others whether the self-defense wearable is armed or disarmed. That or another visual indicator can be employed also to indicate battery strength.

A preferred body portion can have one layer of material comprising an electrically conductive sub-layer and a second layer comprising an outer shell that overlies the electrically conductive sub-layer. Under such a construction, the electrically conductive sub-layer can be formed by a substrate with the electrically conductive pathway applied thereto. The electrically conductive pathway can be formed by one or more strands of conductive material, such as conductive wire, conductive fiber, or conductive paint. An interior lining can be provided for being disposed in contact with a wearer, and an electrically insulative sub-layer can be interposed between the interior lining and the electrically conductive sub-layer. The interior lining can preferably be coupled to the electrically insulative sub-layer by a plurality of coupling tabs of insulative polymeric material, such as rubber, that are interposed between the interior lining and the electrically insulative sub-layer. With this, the interior lining need not be fastened directly to the electrically insulative sub-layer such that potential damage to the electrically insulative sub-layer can be avoided.

In certain embodiments, all or a portion of the electric charge can be visually exposed relative to the outer shell. In such a case, the exposed electric charge can be produced by first and second conductive terminals, which can comprise part of the conductive pathway, separated by a given gap. As a result, an exposed electric arc will be produced between the terminals when sufficient electrical power is provided. The first and second conductive terminals can be incorporated into an electrically charged seam construction that includes a channel formed in the outer shell that exposes at least part of the gap between the first and second conductive terminals. In one construction, the first and second conductive terminals can be sandwiched between the outer shell and the substrate adjacent to opposing terminal faces in the outer shell. Under such an embodiment, when electricity is sent along the conductive pathway at a sufficient level, the electricity will tend to span the gap between the first and second conductive terminals thereby creating the exposed electric arc.

The self-defense wearable could further include a means for adjusting the power of the electric arc. Although that means could comprise a dial or the like, one embodiment of the self-defense wearable allows an adjustment of the power of the electric charge by producing an electric arc with a power that is dependent on a degree to which a compression-type activating switch is compressed. In one potential refinement of the invention, there could be a means for producing a constant or intermittent electric arc, most likely over a small segment of the electrically conductive pathway, even while the activating means is not activated. Such an arc could provide a constant or intermittent indication of the electrically conductive character of the self-defense wearable and, additionally or alternatively, could function as an indication of the source of the self-defense wearable.

The wearable certainly could take a number of forms within the scope of the invention. In one embodiment, for example, it can be an upper body covering, such as a jacket. As such, it will have a torso portion and first and second arms. The activating switch can be a pressure activated switch and can be disposed adjacent to a distal end of the first arm on a tongue that underlies the wearer's palm. With that, the self-defense wearable can be induced into a charged condition by a clenching of the wearer's hand, a natural response to an attack situation. In a still more particular embodiment, the arm or arms where the switch is so disposed can terminate in an extended cuff formed by a first jaw and a second jaw with the tongue being disposed between the first and second jaws.

With a basic object of the invention being the provision of an effective self-defense mechanism for women, embodiments of the invention can be designed and crafted with a goal of limiting their use to women. As such, the dimensions and details of the self-defense wearable could be selected to accommodate the sizes and shapes common to women to the exclusion of the sizes and shapes common to men. Still further, the self-defense wearable could incorporate a means for preventing activation of the self-defense wearable based on the sex of the wearer.

With a plurality of embodiments of the present invention briefly described, one will appreciate that the foregoing discussion broadly outlines the more important features of the invention merely to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for an electrically charged self-defense wearable is subject to a wide variety of embodiments. However, to ensure that one skilled in the art will fully understand and, in appropriate cases, be able to practice the present invention, certain preferred embodiments of the broader invention revealed herein are described below and shown in the accompanying drawings.

Figure 1:
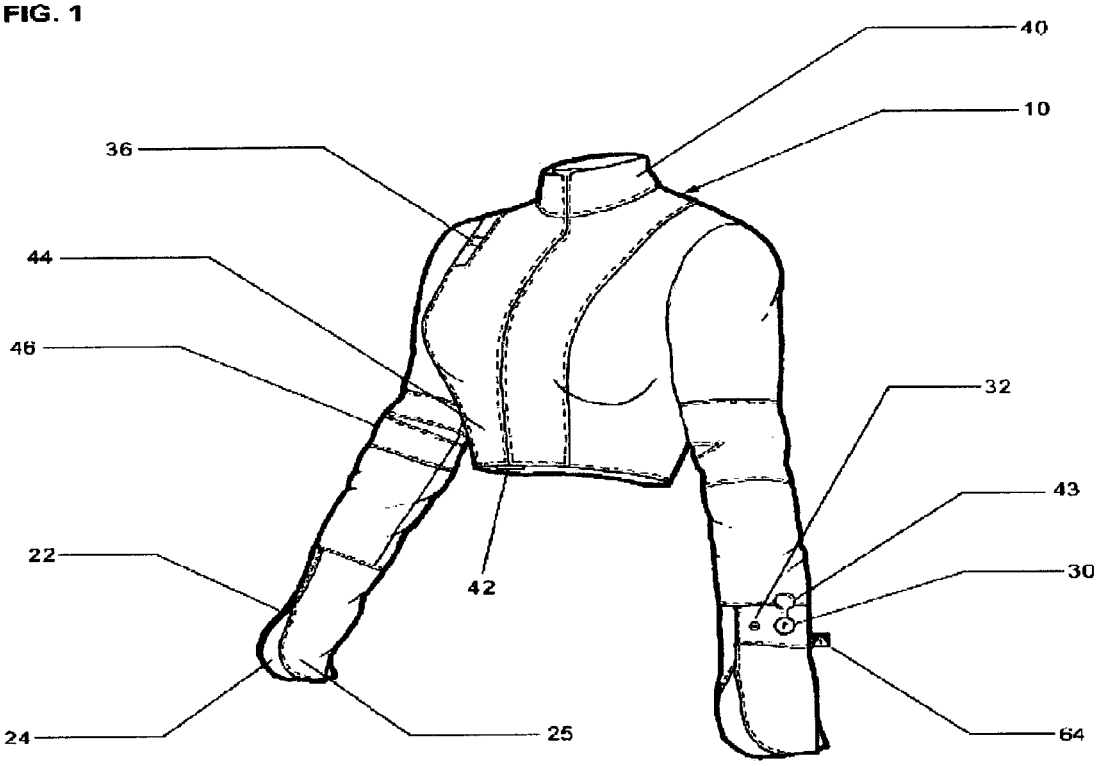
FIG. 1 is a frontal perspective view of an electrically charged self-defense wearable according to the present invention.

With this in mind and looking more particularly to the accompanying figures, a first preferred embodiment of the present invention for an electrically charged self-defense wearable is indicated generally at 10 in FIG. 1. There, one sees that the electrically charged self-defense wearable 10 has a body portion for overlying one or more body parts of a wearer. In this case, the self-defense wearable 10 takes the form of an upper body covering, such as a jacket. As such, the exemplary electrically charged self-defense wearable 10 has a torso portion 44 with a collar portion 40 rising therefrom, a right arm 46, and a left arm 48. Each of the left and right arms 46 and 48 terminates in an extended cuff 22. As shown, for example, in FIG. 4A, each extended cuff 22 includes a first jaw 24 and a second jaw 25 that together form an open mouth. A tongue 27 is disposed between the first and second jaws 24 and 25 and is retained by the respective arm 46 or 48 of the electrically charged self-defense wearable 10. Under this arrangement, the electrically charged self-defense wearable 10 encapsulates substantially the entirety of the wearer's torso, neck, arms, and hands.

Advantageously, however, the open mouth of the extended cuffs 22 allows the wearer use of her hands. By combined reference to FIGS. 1 and 4A, 4B, and 4C, one sees that, while overlying the wearer's hands to provide protection against any electrical charge the self-defense wearable 10 might produce, the first and second jaws 24 and 25 are separated on each side by slits or openings. With this, the wearer enjoys substantially full hand mobility and dexterity. In an alternative construction, which is not particularly shown, the first and second jaws 24 and 25 could alternatively or additionally be flared or otherwise widened to allow the desired use of the wearer's hands.

Figure 6:
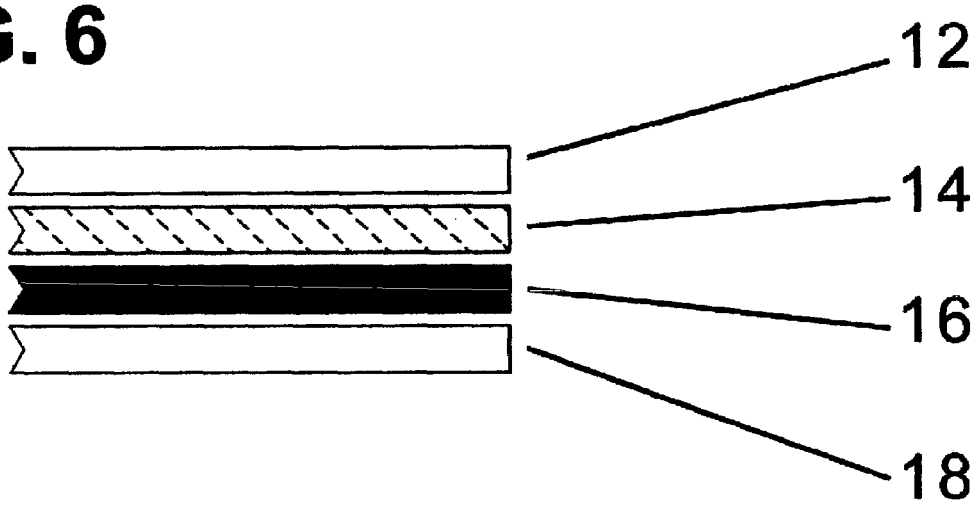
FIG. 6 is a cross-sectional view of a portion of the electrically charged self-defense wearable.

Looking to FIG. 6, which provides a cross section of a portion of the self-defense wearable 10, one sees that the self-defense wearable 10 is formed with an outer shell 12 that overlies an electrically conductive sub-layer 14. In turn, the electrically conductive sub-layer 14 overlies an electrically insulative sub-layer 16. Finally, an interior lining 18 of any suitable material is provided for being disposed proximal to a wearer's body. The outer shell 12 of the self-defense wearable 10 can preferably be crafted from a textile that will be water resistant and protective against ultraviolet radiation to protect and prevent deterioration of the electrically insulative sub layer 16. The seams 58 in the outer shell 12 preferably will be waterproofed by, for example, a sealing tape 60 on the underside of the seams 58 or by another means for preventing moisture from penetrating the outer shell 12 to reach the electrically conductive sub-layer 14.

Figure 2A:
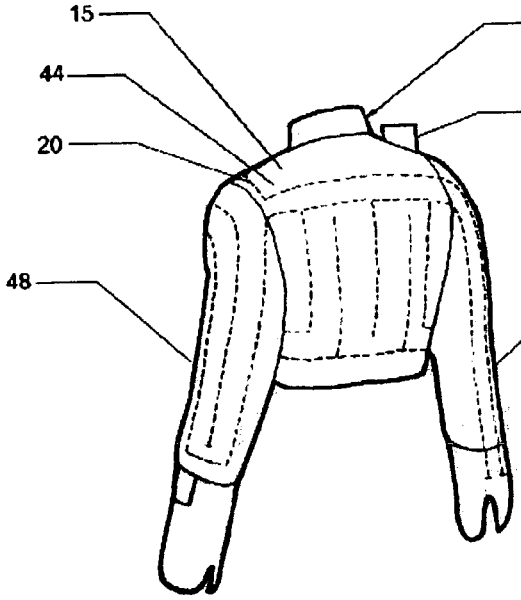
FIG. 2A is a rear perspective view of an electrically conductive sub-layer of the electrically charged self-defense wearable.
Figure 2B:
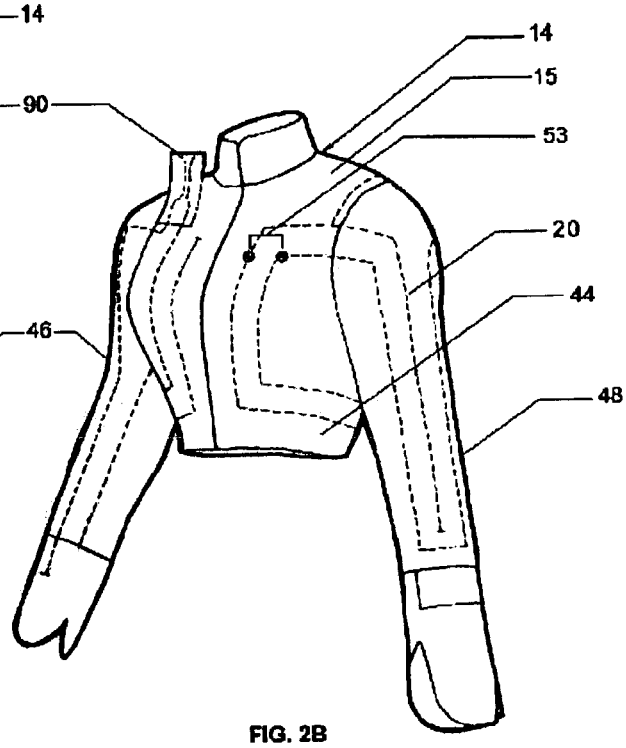
FIG. 2B is a frontal perspective view of the electrically conductive sub-layer of the electrically charged self-defense wearable.

As can be seen by reference to FIGS. 2A and 2B, the electrically conductive sub-layer 14 of the self-defense wearable 10 preferably will be founded on a non-conductive substrate 15. Preferably, the non-conductive substrate 15 will comprise a textile, which can be protective against ultraviolet radiation thereby to protect and prevent deterioration of the electrically insulative sub layer 16 beneath. In one embodiment, the non-conductive substrate 15 can be formed from a polymeric material, such as a layer of rubber. The electrical conductivity of the electrically conductive sub-layer 14 is produced by an electrically conductive pathway 20 that is applied to the distal surface of the non-conductive substrate 15. As does the fully assembled self-defense wearable 10, the electrically conductive sub-layer 14 encapsulates the wearer's torso, neck, arms, and hands.

The conductive pathway 20 can be formed from a flexible conductive material, such as wire or wire mesh. Alternatively or additionally, the electrically conductive sub-layer 14 can be formed with an electrically conductive textile formed onto the non-conductive substrate 15. In a presently preferred arrangement, however, the conductive pathway 20 can be formed by a conductive fiber or thread that can be sewn, woven, or otherwise incorporated into the non-conductive substrate 15. Alternatively, the conductive pathway 20 could be formed by applying a conductive material, such as a paint, to the non-conductive substrate 15 by any appropriate process, such as screen printing or any other appropriate method. When the conductive pathway 20 is formed under any of the described methods, the self-defense wearable 10 advantageously remains comfortably wearable and relatively easily manufactured.

The conductive pathway 20 of the electrically conductive sub-layer 14 follows a given pathway pattern over the distal surface of the non-conductive substrate 15. The pattern of conductive material, whether it be conductive strands of thread, conductive wire, conductive paint, or any other suitable material, that forms the conductive pathway 20 preferably has adjacent lengths of conductive material generally spaced no less than one inch from each other such that they remain separated as two independent terminals as is discussed further herein. The conductive pathway 20 preferably will traverse the torso 44 and arms 46 and 48 thereby providing the wearer's body and arms with protective surface coverage.

However, the conductive pathway 20 should be patterned to avoid areas where the conductive material might short, such as where a thread or fiber acting as the conductive material could potentially contact itself or another thread or fiber. In addition, to prevent inadvertent contact with the wearer, the conductive pathway 20 preferably will avoid being disposed where the head and face of the wearer could come into contact therewith. As such, it will preferably avoid the area within the radial rotation or extension of the wearer's head and the areas of the interior shoulder, upper chest, neck, and underarms. This preferred arrangement of the conductive pathway 20 is supplemented in protecting the wearer from inadvertent shock by, among other things, the extended collar 40, which comprises a relatively high and wide shield. Also, as can be seen, for example, in FIG. 1, the self-defense wearable 10 has a protective zipper flap 42 of electrically insulative material for protecting the wearer from inadvertent shock through the zipper area of the self-defense wearable 10.

Figure 7A:
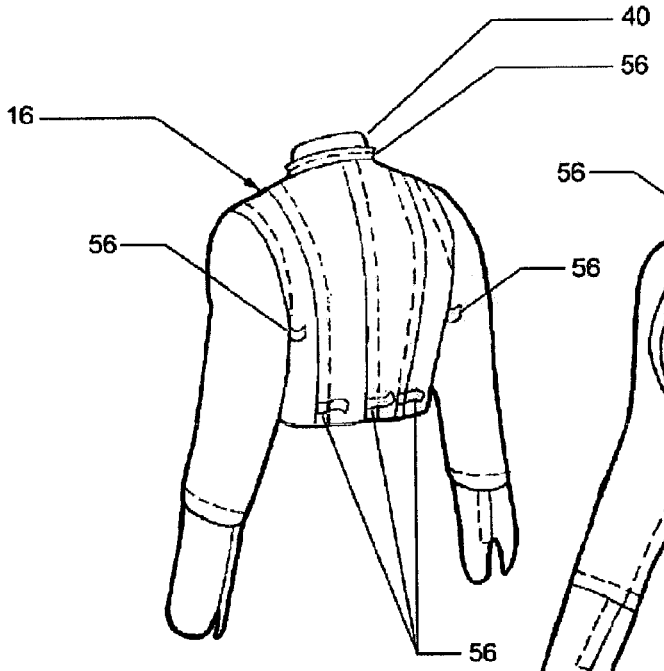
FIG. 7A is a rear perspective view of an electrically insulative sub-layer of the electrically charged self-defense wearable.
Figure 7B:
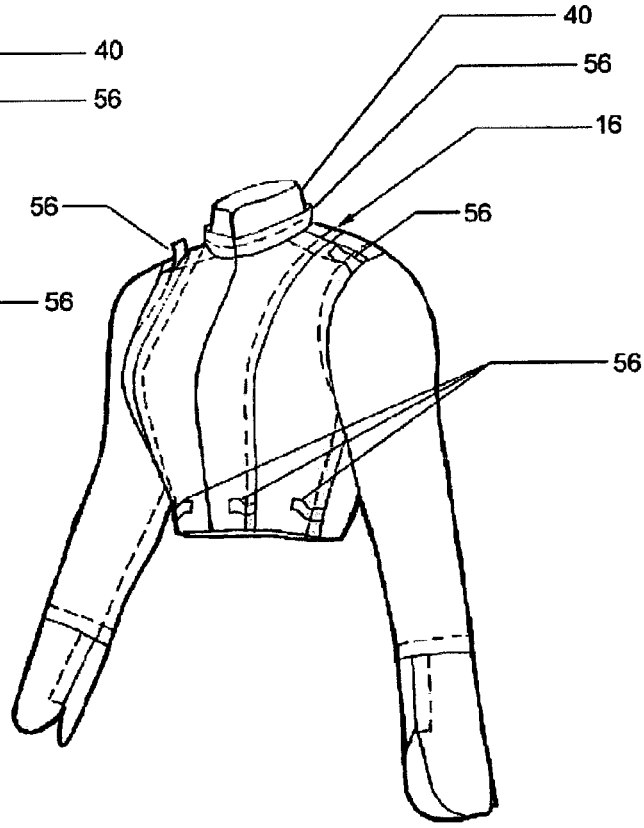
FIG. 7B is a front perspective view of the electrically insulative sub-layer of the electrically charged self-defense wearable.

As its name would suggest, the electrically insulative sub-layer 16, which is exposed in FIGS. 7A and 7B, of the self-defense wearable 10 preferably will be founded on an electrically insulative material. Where the self-defense wearable 10 is designed to protect the upper body of the wearer as in the jacket of the present embodiment, the electrically insulative sub-layer 16 again will comprise a covering of the wearer's torso, neck, arms, and hands. Because the preferred power source 28 is capable of operating in a high voltage (i.e., 20 kV to 100 kV) format, the electrically insulative sub-layer 16 is specifically needed for enabling the self-defense wearable 10 to be operated without imparting a shock to the wearer.

The self-defense wearable 10 is unique in its high voltage operation and offers many advantages over prior art lower voltage wearable systems. For example, under the present invention's high voltage format wherein voltages ranging from approximately 20 kV to 100 kV can be employed, electricity can be made to jump and pass through porous material up to roughly one inch thick or more such that a need for direct contact between a body and a conductive terminal is obviated. That is enabled, in part, by the electrically insulative sub-layer 16, which protects the wearer from the high voltage charge. Of course, after reading this disclosure, one skilled in the art would find a number of suitable materials for the electrically insulative sub-layer 16 obvious. One presently preferred material for the electrically insulative sub-layer 16 is rubber or a rubberized material.

In addition to the specific material requirements necessitated by the high voltage format, particular construction methods are desirable for allowing the self-defense wearable 10 to be worn without risk of inadvertent shock. For example, any seams or perforations in the electrically insulative sub-layer 16 ideally will be sealed, such as by electrically insulative adhesive, to be impervious to electricity. Furthermore, in one preferred embodiment, an overlap of one inch or more in the seams of the electrically insulative sub-layer 16 is provided to prevent electricity from arcing through the seam should the adhesive or other sealant fail or be insufficient. On seams where such an overlap is not possible, a separate strip of electrically insulative material can be centered on the underside of the seam and adhered thereto.

In this presently preferred embodiment, the interior lining 18 is coupled to the electrically insulative sub-layer 16 by coupling tabs 56 that are evenly spaced over and positioned on the seams of the torso 44 and arms 46 and 48 and an extended coupling tab 56 around the neck 40. The coupling tabs 56 can be formed from an insulative polymeric material, such as rubber, of a given thickness. They can be joined with the electrically insulative sub-layer 16 by, for example, gluing or any other appropriate method. The interior lining 18 can be sewn or otherwise coupled to the coupling tabs 56. With this, the interior lining 18 will be supported against sagging and the like while limiting stitching holes and other damage to the electrically insulative sub-layer 16 thereby further preventing high voltage electricity from reaching the wearer.

Figure 3:
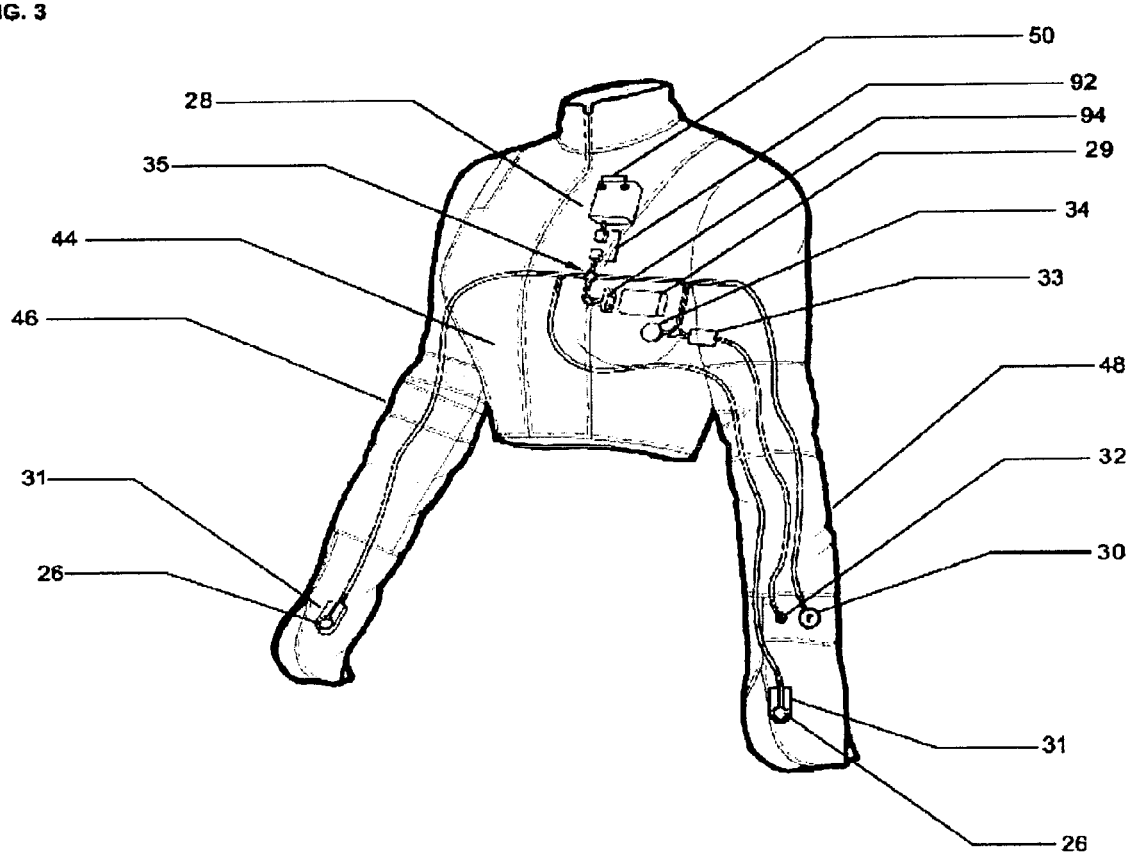
FIG. 3 is a frontal perspective view of an interior wiring network of the electrically charged self-defense wearable depicting a cradle system for retaining a removable power source, sleeve/cuff switches, a battery, a visual indicator, and a control circuit and associated battery according to the present invention.

In FIG. 3, a preferred interior wiring network 35 is shown as it might be embedded within the self-defense wearable 10. When the self-defense wearable 10 is armed and charged, power is provided by a high voltage power source 28 that can produce a voltage differential between the conductive terminals of the conductive pathways 20 as will be described herein. Of course, the voltage differential could vary widely within the scope of the invention depending on a number of factors. In certain preferred embodiments, the voltage output of the power source 28, and thus the electrical charge output by the self-defense wearable 10, can be controlled by one or more means for adjusting the actual or potential voltage output. As such, the adjusting means could vary the voltage output from a given minimum to a given maximum. Alternatively or additionally, the adjusting means could toggle the actual or potential voltage output between an on condition and an off condition. As one will appreciate, the adjusting means could take a number of forms that would be well within the scope of the present invention.

Under one embodiment, the voltage output adjusting means could be geographically controlled by Global Positioning System (GPS) coordinates such that it could be adjusted or it could adjust automatically based on local laws and regulations and, additionally or alternatively, based on levels of danger associated with given areas derived, for example, from crime statistics. Alternatively or additionally, the voltage output adjusting means could be controlled by biofeedback sensors that could activate or adjust the voltage based on, for example, the wearer's level of fear or other biofeedback, such as heart rate, galvanic skin response, or blood pressure. Even further, the voltage output adjusting means could be controlled by a wearer's voice commands. Still further, the voltage output adjusting means could employ impact sensors that activate or adjust the voltage based on an impact or on a level of impact to the wearer.

As FIG. 3 also shows, the self-defense wearable 10 further incorporates an arming device 30 by which the power source 28 can be armed or disarmed to enable or disable electric power. The arming device 30 certainly could comprise a simple switch, knob, or any other generally operable arrangement. However, it may be preferable for the arming device 30 to be coded meaning that it would include a means for preventing unauthorized operation of the arming device 30. A number of coded arming devices 30 would occur to one skilled in the art. For example, as it is depicted in FIG. 3, the coded arming device 30 could be a key switch for being turned by a key (not shown) between an armed position where the use of one or both of the activating switches 26 can charge the self-defense wearable 10 and a disarmed position wherein the self-defense wearable 10 cannot be induced into a charged condition. Alternatively, the coded arming device 30 could be an alphanumeric keypad, a dial combination switch, or any other suitable coded mechanism.

The arming device 30 could be located anywhere on the interior or exterior of the self-defense wearable 10. However, in the embodiment of FIG. 3, the arming device 30 is located on the exterior of a distal portion of the left arm 48 of the self-defense wearable 10, such as on the extended cuff 22. As FIG. 1 shows, a shield 43, such as a rubber cap structure that can be plugged into a protective position, is preferably provided for protecting the arming device 30 from moisture and other contamination. If the arming device 30 is located on the exterior of the self-defense wearable 10, then a rubber backing, which could be formed by the shield 43, preferably will be used to line the inner surface of the arming device 30.

Since the arming status of the self-defense wearable 10 certainly would be important for a number of reasons, the self-defense wearable 10 further incorporates a means for indicating whether the self-defense wearable 10 is armed or disarmed. In this embodiment, the indicating means comprises a visual indicator 32, which is shown in FIGS. 1 and 3. Ideally, the self-defense wearable 10 will also provide a means for indicating battery strength. In this embodiment, the visual indicator 32 also acts as that battery strength indicator. Under one possible arrangement, for example, the visual indicator 32 could comprise a light-emitting diode, which could flash to indicate low power and could remain in an on condition to indicate that the self-defense wearable 10 is armed and has sufficient battery power. Although the visual indicator 32 certainly could be located substantially anywhere on the self-defense wearable 10, the visual indicator 32 in the present embodiment is disposed adjacent to the arming device 30.

Figure 8:
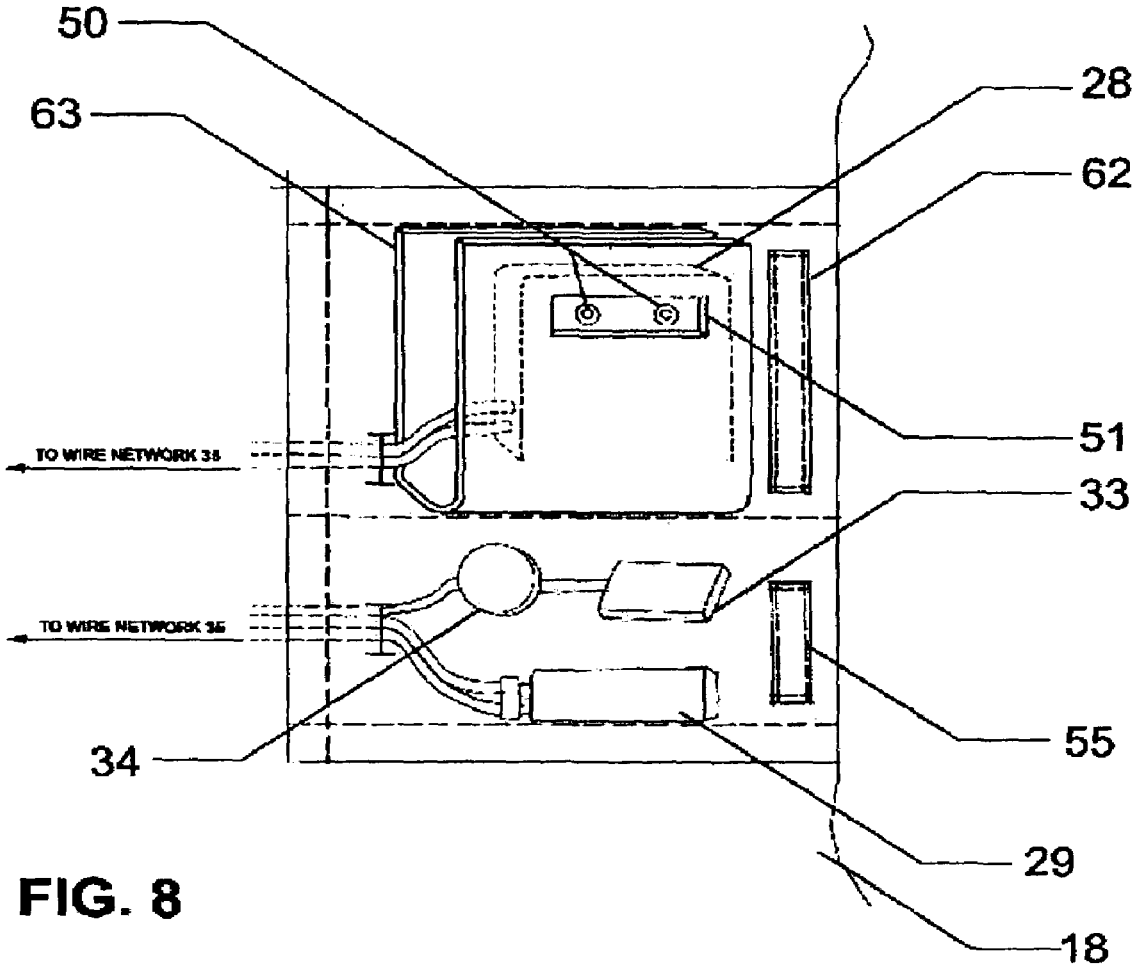
FIG. 8 is a sectioned view in front elevation of a pocket in the interior lining of the electrically charged self-defense wearable.

Looking to FIGS. 3 and 8, one sees that the self-defense wearable 10 further incorporates a rubber lined retaining pocket 62 located in the interior lining 18. The rubber lined retaining pocket 62 retains the power source 28, which is removable and replaceable relative to the wire network by use of a connector 92. The connector 92, the wire network 35, and the battery connector 94 electrically associate the power source 28 with the battery 29. They also cooperate to couple the power source 28, the battery 29, the arming device 30, the visual indicator 32, the LED circuit 33, the LED battery 34, and the activating switches 26 to the wire network 35. A battery pocket 55 is located just below the rubber lined retaining pocket 62 for holding the battery 29 and the LED circuit 33.

The power source 28 is electrically coupled to the conductive pathways 20 of the electrically conductive sub-layer 14 by conductive snap engagement members 50 that are embedded in the power source 28 to act as two voltage differential terminals. The conductive snap engagement members 50 are accessible through an opening 51 through the lining layer 18 and electrically insulative layer 16 to snap into conductive snap engagement member counterparts 53, shown in FIG. 2B, that are electrically and mechanically connected to the conductive pathways 20 of the electrically conductive sub-layer 14. Under this arrangement, all elements of the wire network 35 can be disposed in electrical association with one another, either directly or through another element. Advantageously, the rubber lined retaining pocket 62 interfaces through to the inner surface of the lining 18 thereby allowing convenient access to the power source 28 and other electrical components of the self-defense wearable 10. With that, the power source 28 under this arrangement can be swapped in a modular manner between different wearables that are crafted pursuant to the present invention. In this preferred embodiment, the power source 28 is further enveloped by an electrically insulative U-shaped lining 63 that provides further electrical isolation relative to the power source 28.

The self-defense wearable 10 certainly could be activated by a wide variety of possible activating means within the scope of the present invention. Under the present embodiment, the self-defense wearable 10 employs what is considered to be a uniquely advantageous arrangement for activating the power source 28 and, by doing so, the conductive pathway 20 to induce the self-defense wearable 10 into a charged condition provided the self-defense wearable 10 is in an armed condition. As one can see best with reference to FIG. 4A, the self-defense wearable 10 has an activating switch 26 disposed adjacent to the distal end of each of the tongues 27, which are disposed between the first and second jaws 24 and 25 of each of the arms 46 and 48. The preferred activating switches 26 comprise pressure activated activating switches, which can be sized to fit generally into the wearer's palm, that are triggered by a pressing or squeezing thereof. As shown best in FIGS. 3 and 4A, the activating switches 26 are positioned within recesses in rigid or semi-rigid housings 31 thereby making the activating switches 26 less likely to be triggered accidentally.

The self-defense wearable 10 can be designed to enter a charged condition upon a triggering of either activating switch 26 or only upon a simultaneous triggering of both activating switches 26. Under certain embodiments, the level of activation of the self-defense wearable 10 can be dependent on the degree to which the activating switches 26 are pressed or squeezed. To help ensure that the tongues 27 retain their structural integrity and location between the first and second jaws 24 and 25, they can be formed with a generally rigid structure, such as by incorporating a panel of rigid foam, a skeletal structure, or some other arrangement. Furthermore, the activating switches 26 and the wiring leading thereto are preferably water and weather resistant.

Figures 4A, 4B, 4C:
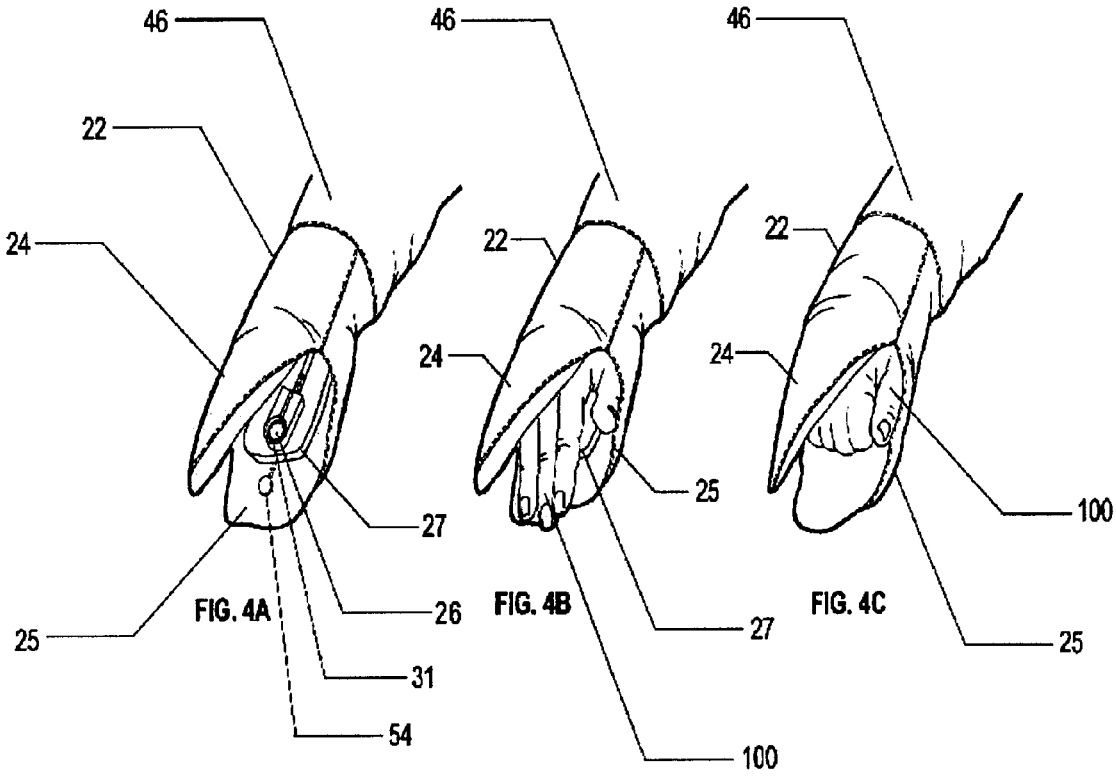
FIG. 4A is a perspective view of a sleeve/cuff portion of the electrically charged self-defense wearable.
FIG. 4B is a perspective view of the sleeve/cuff portion of FIG. 4A with a wearer's hand in a relaxed position.
FIG. 4C is a perspective view of the sleeve/cuff portion of FIG. 4A with the wearer's hand in a clenched position.

In FIG. 4B, a wearer's hand 100 is disposed within the extended cuff 22 as it would be in a preferred wearing arrangement. With this, one sees that the tongues 27 are sized and disposed to underlie the wrist or palm of the wearer with the wearer's fingers ideally extending therebeyond. Under this arrangement, the wearer can induce the self-defense wearable 10 into a charged condition simply by clenching one or both of her hands 100 about one or both of the tongues 27 as is shown in FIG. 4C thereby compressing or otherwise triggering the activating switch or switches 26. Advantageously, this arrangement exploits the natural response of most persons to an attack, namely a clenching of her fists. With this, the self-defense wearable 10 can be induced into a charged condition by the wearer substantially immediately upon an attack without a need for searching for a switching mechanism and without requiring a dangerous always-armed condition. When armed and charged, the self-defense wearable 10 will ultimately exact a charge on a physical assailant by producing a voltage differential between the two separated lines of the conductive pathway 20 on the electrically conductive sub-layer 14. Although the electrically conductive sub-layer 14 is covered by the outer shell 12, high voltage can pass readily through the material of the outer shell 12 to be imparted to an assailant who is in contact with or in immediate proximity to the wearer.

Figure 5:
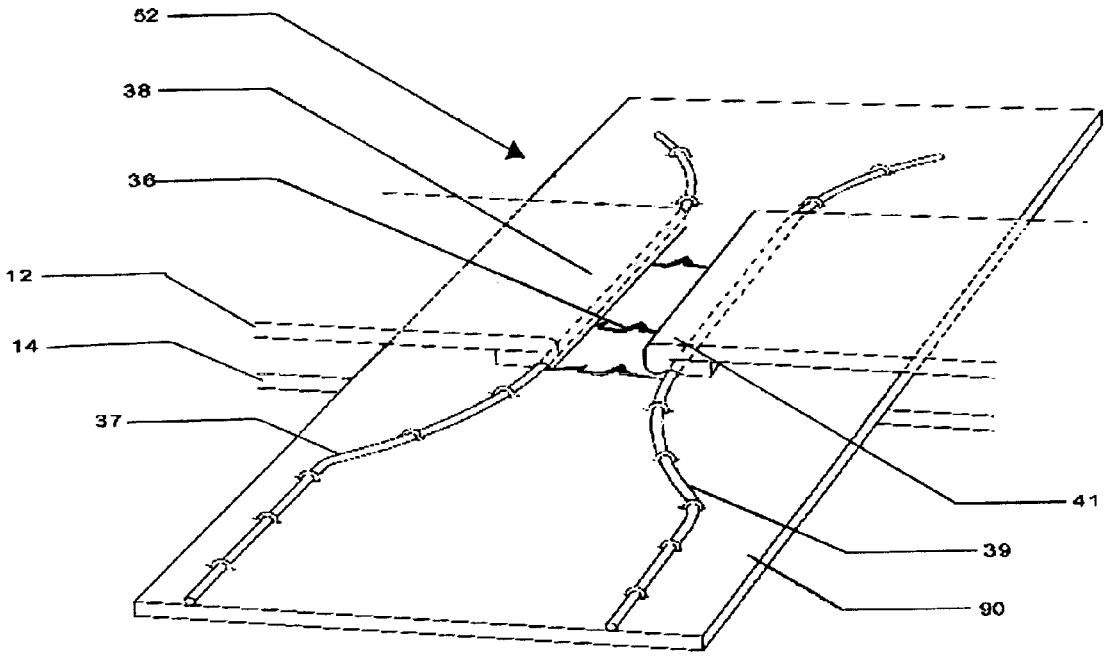
FIG. 5 is a sectioned perspective view of an electrically charged seam construction for controlling a visible arc of electricity according to the present invention.

The self-defense wearable 10 could further incorporate a means for producing a visually exposed electric arc. In this embodiment, that means comprises an electrically charged seam construction 52, shown in an enlarged view in FIG. 5, that is integrated into a portion of the outer shell 12. The electrically charged seam construction 52 is formed by a combination of the outer shell 12 and conductive terminals 37 and 39, which comprise leads from the electrically conductive sub-layer 14. As FIGS. 2A, 2B, and 5 show, an insert tab 90 is sewn or otherwise secured in place and is connected to the conductive pathway 20 of the electrically conductive sub-layer 14. Over the span of the insert tab 90, which can also be considered an under layer 90, the first and second conductive terminals 37 and 39 transition from portions separated by a given distance, such as roughly one inch or more, to a narrowed portion separated by a lesser distance, such as between roughly ½ and ¾ inches. Preferably, the first and second conductive terminals 37 and 39 will be maintained generally parallel over the narrowed portion such that the distance between them will be constant over that portion.

A channel with opposing faces is formed in the material forming the outer shell 12. The channel could be formed in any appropriate manner, including by a simple termination of adjacent material sections of the outer shell 12. In this embodiment, the channel is formed by a folding over and securing, such as by sewing, of adjacent sections of the outer shell 12 to form first and second construction seams 38 and 41. The first and second conductive terminals 37 and 39, which are segments of the conductive pathway 20, are disposed to opposite sides of the channel, and the channel can be formed only over the length where the first and second conductive terminals 37 and 39 are separated by the consistent narrowed distance. As such, the first and second conductive terminals 37 and 39 form spaced first and second strands of conductive material, such as conductive thread, conductive fiber, conductive paint, or any other functional conductive material. In this case, the first and second conductive terminals 37 and 39 are sandwiched between the opposing faces of the outer shell 12 and an under layer 90 of the outer shell 12. The substrate 15 of the electrically conductive sub-layer 14 lies just beneath the under layer 90. Under this arrangement, when the self-defense wearable 10 is armed and charged, electricity will be sent along the conductive pathway 20 and will tend to span the narrowed portion of the gap between the first and second conductive terminals 37 and 39 thereby creating an exposed electric arc 36. Where the first and second conductive terminals 37 and 39 are evenly spaced over the narrowed portion, the particular location of the electric arc or arcs 36 will vary generally randomly.

If touched, the exposed electric arc 36 will be tactile to a physical assailant such that it will induce at least some level of discomfort or pain, which would naturally tend to discourage further attack. Advantageously, the electric arc 36 will also be visible and audible. As such, it will tend to intimidate and discourage any contemplated or threatened attack. Furthermore, the tactile, visible, and audible characteristics of the electric arc 36 can be accentuated, such as by the degree to which the activating switches 26 are pressed or squeezed, by a control dial or switch 54, which is shown in FIG. 4A, or by any other means for adjusting the power of the electric arc, to provide added discomfort, pain, intimidation, or discouragement if circumstances warrant.

Under certain embodiments of the self-defense wearable 10, all or merely the area of the conductive pathway 20 that comprises the means for producing a visually exposed electric arc can be continuously or continually charged whereby an exposed electric arc 36 or electric arcs 36 can be produced constantly or intermittently for apprising others, including would-be assailants, of the electrically conductive character of the self-defense wearable 10. Such a constant or continuous electric arc 36 could additionally be employed in certain embodiments as a particularly unique source indicator for the self-defense wearable 10. For example, while the remainder of the conductive pathway 20 could be armed and charged as previously described in response to an actual or threatened attack, an exposed electric arc 36 could be produced intermittently or constantly in a predetermined location to act as an indicator of the source or brand of the self-defense wearable 10.

One or more warning labels 64 can be applied to select locations on the outer shell 12 and, additionally or alternatively, the interior lining 18. The warning labels 64 could be of a color, such as yellow or red, designed to have inherent warning capabilities. The color of the warning labels 64 can be supplemented by descriptive warning text or graphics. As such, the warning labels 64 can warn and remind bystanders and the wearer herself of the self-defense capabilities and potential dangers of the self-defense wearable 10.

As one reviewing the drawing figures will appreciate, the embodiment of the self-defense wearable 10 shown herein is crafted specifically for female wearers in light of the typically more pronounced security concerns of women as compared to men. As such, the preferred self-defense wearable 10 has a plurality of refinements designed for limiting the wearing of the self-defense wearable 10 to women, ideally to the exclusion of men where so intended. To carry this forth, the self-defense wearable 10 has princess seams, a fuller bust, smaller sizing, and relatively narrow armholes such that it would not be likely to fit a man comfortably. With this, the risk of men adopting such embodiments of the self-defense wearable 10 can be reduced. Of course, one will appreciate that the self-defense wearable 10 could be readily designed and crafted for being worn specifically by men and, additionally or alternatively, for unisex wear.

In a still more advanced embodiment of the self-defense wearable 10, the sizing and construction of the self-defense wearable 10 can be supplemented in limiting the wearing of the self-defense wearable 10 to wearer's of a given sex, such as women, by a means for sensing the wearer's sex and for arming, disarming, or preventing the arming or charging of the self-defense wearable 10 based on the sensed sex of the wearer. Under one such construction, for example, the sensing means can sense whether the wearer is a man or a woman and can enable the arming or charging of the self-defense wearable 10 only when the wearer is a woman. Although a number of types of such sensing means could be incorporated, one presently preferred sensing means could gain a reading of the hormone levels of the wearer and determine the wearer's sex based thereon.

From the foregoing, it will be clear that the present invention has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventors, and the claims shall be deemed to include equivalent constructions insofar as they do not depart from the spirit and scope of the present invention. A plurality of the following claims may express certain elements as a means for performing a specific function, at times without the recital of structure or material. As the law demands, these claims shall be construed to cover not only the corresponding structure and material expressly described in this specification but also equivalents thereof.

We claim as deserving the protection of Letters Patent:

1. A high voltage self-defense wearable for enabling a wearer to exact or threaten a high voltage electrical charge on a physical assailant, the self-defense wearable comprising:

a body portion for overlying one or more body parts of a wearer wherein the body portion has an outer surface for being disposed distal to a wearer's body and an inner surface for being disposed proximal to a wearer's body and wherein the body portion is formed of at least one layer of material;

a means for producing a high voltage electrical charge in electrical communication with the outer surface of the body portion comprising an electrically conductive material operably associated with at least a portion of the at least one layer of material, a power source for providing electrical power to the electrically conductive material wherein the power source is retained by the body portion, at least one activating switch for inducing the self-defense wearable into a charged condition wherein the power source provides electrical power to the electrically conductive material to produce a high voltage electrical charge that is in electrical communication with the outer surface of the body portion, and a means for producing an electrical association between the electrically conductive material, the power source, and the at least one activating switch; and a means for preventing the high voltage electrical charge from reaching the wearer through the inner surface of the body portion comprising an electrically insulative sub-layer of electrically insulative material disposed proximal to the electrically conductive material such that it would be interposed between the electrically conductive material and the wearer's body during a wearing of the self-defense wearable wherein the electrically insulative sub-layer is formed from a polymeric material and wherein the electrically insulative sub-layer traverses substantially the entire inner surface of the body portion.

2. The self-defense wearable of claim 1 wherein the electrically insulative sub-layer has one or more seams therein and wherein the electrically insulative material overlaps at least approximately one inch over at least a portion of the one or more seams for further preventing the high voltage electrical charge from reaching the wearer.

3. The self-defense wearable of claim 1 wherein the electrically insulative sub-layer has one or more seams therein and wherein at least a portion of the one or more seams is sealed by an electrically insulative adhesive for further preventing the high voltage electrical charge from reaching the wearer.

4. The self-defense wearable of claim 1 further comprising an interior lining disposed proximal to the electrically insulative sub-layer wherein the interior lining is coupled to the electrically insulative sub-layer by coupling tabs interposed therebetween thereby avoiding a need for directly fastening the interior lining to the electrically insulative sub-layer.

5. The self-defense wearable of claim 1 wherein the electrically conductive material comprises a conductive pathway of electrically conductive material disposed over a substrate.

6. The self-defense wearable of claim 5 wherein the electrically conductive material is chosen from the group consisting of conductive wire, conductive thread, and conductive paint.

7. The self-defense wearable of claim 5 wherein the body portion comprises an upper body covering with a torso portion and first and second arms.

8. The self-defense wearable of claim 7 wherein the conductive pathway is patterned to avoid areas where portions of the conductive pathway could contact itself and to avoid areas where a head and face of the wearer could come into contact with the conductive pathway.

9. A high voltage self-defense wearable for enabling a wearer to exact or threaten a high voltage electrical charge on a physical assailant, the self-defense wearable comprising:

a body portion for overlying one or more body parts of a wearer wherein the body portion has an outer surface for being disposed distal to a wearer's body and an inner surface for being disposed proximal to a wearer's body and wherein the body portion is formed of at least one layer of material;

a means for producing a high voltage electrical charge in electrical communication with the outer surface of the body portion comprising an electrically conductive material operably associated with at least a portion of the at least one layer of material, a power source for providing electrical power to the electrically conductive material wherein the power source is retained by the body portion, at least one activating switch for inducing the self-defense wearable into a charged condition wherein the power source provides electrical power to the electrically conductive material to produce a high voltage electrical charge that is in electrical communication with the outer surface of the body portion, and a means for producing an electrical association between the electrically conductive material, the power source, and the at least one activating switch;

a means for preventing the high voltage electrical charge from reaching the wearer through the inner surface of the body portion; and an arming device for arming and disarming the self-defense wearable to enable or disable electrical power transmission between the power source and the electrically conductive material.

10. The self-defense wearable of claim 9 wherein the means for preventing the high voltage electrical charge from reaching the wearer through the inner surface of the body portion comprises an electrically insulative sub-layer of electrically insulative material disposed proximal to the electrically conductive material such that it would be interposed between the electrically conductive material and the wearer's body during a wearing of the self-defense wearable.

11. The self-defense wearable of claim 9 wherein the power source is removably retained relative to the body portion and relative to the means for producing an electrical association between the electrically conductive material, the power source, and the at least one activating switch.

12. The self-defense wearable of claim 11 wherein the power source is removably retained by conductive snap engagement members.

13. The self-defense wearable of claim 9 wherein the arming device comprises a coded arming device.

14. A high voltage self-defense wearable for enabling a wearer to exact or threaten a high voltage electrical charge on a physical assailant, the self-defense wearable comprising:

a body portion for overlying one or more body parts of a wearer wherein the body portion has an outer surface for being disposed distal to a wearer's body and an inner surface for being disposed proximal to a wearer's body and wherein, the body portion is formed of at least one layer of material;

a means for producing a high voltage electrical charge in electrical communication with the outer surface of the body portion comprising an electrically conductive material operably associated with at least a portion of the at least one layer of material, a power source for providing electrical power to the electrically conductive material wherein the power source is retained by the body portion, at least one activating switch for inducing the self-defense wearable into a charged condition wherein the power source provides electrical power to the electrically conductive material to produce a high voltage electrical charge that is in electrical communication with the outer surface of the body portion, and a means for producing an electrical association between the electrically conductive material, the power source, and the at least one activating switch wherein the means associated with the electrically conductive material for producing a high voltage electrical charge in electrical communication with the outer surface of the body portion includes a means for producing a visually exposed electrical charge on the outer surface of the body portion; and a means for preventing the high voltage electrical charge from reaching the wearer through the inner surface of the body portion.

15. The self-defense wearable of claim 14 wherein the means for producing an exposed electrical charge comprises first and second conductive terminals in electrical communication with the electrically conductive material wherein the first and second conductive terminals are separated by a given gap whereby an electric arc will be produced between the first and second conductive terminals when sufficient electrical power is provided to the electrically conductive material by the power source.

16. The self-defense wearable of claim 15 wherein the body portion is formed of at least two layers of material wherein one layer comprises a sub-layer and a second layer comprises an outer shell that overlies the sub-layer, wherein the sub-layer comprises a substrate with the first and second conductive terminals applied thereto, and wherein the outer shell is water resistant.

17. The self-defense wearable of claim 16 wherein the first and second conductive terminals are incorporated into an electrically charged seam construction wherein the electrically charged seam construction includes a channel formed in the outer shell for exposing at least a portion of the gap between the first and second conductive terminals.

18. The self-defense wearable of claim 15 wherein the first and second terminals are disposed generally parallel to one another over a given distance whereby a location of the electric arc between the first and second terminals will vary generally randomly.

19. The self-defense wearable of claim 14 wherein the high voltage electrical charge comprises a charge of at least approximately 20,000 Volts.

20. A high voltage self-defense wearable for enabling a wearer to exact or threaten a high voltage electrical charge on a physical assailant, the self-defense wearable comprising:

a body portion for overlying one or more body parts of a wearer wherein the body portion has an outer surface for being disposed distal to a wearer's body and an inner surface for being disposed proximal to a wearer's body, wherein the body portion is formed of at least one layer of material, and wherein the body portion comprises an upper body covering with a torso portion and first and second arms;

a means for producing a high voltage electrical charge in electrical communication with the outer surface of the body portion comprising an electrically conductive material operably associated with at least a portion of the at least one layer of material, a power source for providing electrical power to the electrically conductive material wherein the power source is retained by the body portion, at least one activating switch for inducing the self-defense wearable into a charged condition wherein the power source provides electrical power to the electrically conductive material to produce a high voltage electrical charge that is in electrical communication with the outer surface of the body portion, and a means for producing an electrical association between the electrically conductive material, the power source, and the at least one activating switch; and a means for preventing the high voltage electrical charge from reaching the wearer through the inner surface of the body portion.

21. The self-defense wearable of claim 20 wherein the at least one activating switch is disposed adjacent to a distal end of the first arm whereby the self-defense wearable can be induced into a charged condition by the wearer's hand.

22. The self-defense wearable of claim 21 wherein the at least one activating switch comprises a pressure activated activating switch.

23. The self-defense wearable of claim 22 wherein the at least one activating switch is disposed to underlie the wearer's palm whereby the self-defense wearable can be induced into a charged condition by a clenching of the wearer's hand.

24. The self-defense wearable of claim 23 wherein a pressure activated activating switch is disposed adjacent to a distal end of the second arm to underlie the wearer's palm.

25. The self-defense wearable of claim 22 wherein a level of charging of the self-defense wearable is variable depending on a given factor.

26. The self-defense wearable of claim 25 wherein the level of charging of the self-defense wearable is dependent on a degree to which the pressure activated activating switch is compressed.

27. The self-defense wearable of claim 21 wherein a tongue is retained adjacent to the distal end of the first arm for underlying the wearer's palm and wherein the at least one activating switch is retained relative to the tongue.

28. The self-defense wearable of claim 27 wherein the first arm terminates in an extended cuff formed by a first jaw and a second jaw and wherein the tongue is disposed between the first jaw and the second jaw.

29. The self-defense wearable of claim 20 further comprising a zipper interposed in the body portion and wherein the means for preventing the high voltage electrical charge from reaching the wearer through the inner surface of the body portion includes an electrically insulative flap secured proximal to the zipper such that it would be interposed between the zipper and the wearer's body during a wearing of the self-defense wearable.

30. The self-defense wearable of claim 20 further comprising a means for preventing activation of the self-defense wearable depending on the sex of the wearer.

31. A self-defense wearable for enabling a wearer to exact or threaten an electrical charge on a physical assailant, the self-defense wearable comprising:

a body portion comprising an upper body covering with a torso portion and first and second arms for overlying an upper body of a wearer wherein the body portion has an outer surface for being disposed distal to a wearer's body and an inner surface for being disposed proximal to a wearer's body and wherein the body portion is formed of at least one layer of material; and a means for producing an electrical charge in electrical communication with the outer surface of the body portion comprising an electrically conductive material operably associated with at least a portion of the at least one layer of material, a power source for providing electrical power to the electrically conductive material wherein the power source is retained by the body portion, at least one activating switch for inducing the self-defense wearable-into a charged condition wherein the power source provides electrical power to the electrically conductive material to produce an electrical-charge that is in electrical communication with the outer surface of the body portion, and a means for producing an electrical association between the electrically conductive material, the power source, and the at least one activating switch;

wherein the at least one activating switch is disposed adjacent to a distal end of the first arm whereby the self-defense wearable can be induced into a charged condition by the wearer's hand.

32. The self-defense wearable of claim 31 wherein the at least one activating switch comprises a pressure activated activating switch.

33. The self-defense wearable of claim 32 wherein the at least one activating switch is disposed to underlie the wearer's palm whereby the self-defense wearable can be induced into a charged condition by a clenching of the wearer's hand.

34. The self-defense wearable of claim 33 wherein a pressure activated activating switch is disposed adjacent to a distal end of the second arm to underlie the wearer's palm.

35. The self-defense wearable of claim 32 wherein a level of charging of the self-defense wearable is dependent on a degree to which the pressure activated activating switch is compressed.

36. The self-defense wearable of claim 31 wherein a tongue is retained adjacent to the distal end of the first arm for underlying the wearer's palm and wherein the at least one activating switch is retained relative to the tongue.

37. The self-defense wearable of claim 36 wherein the first arm terminates in an extended cuff formed by a first jaw and a second jaw and wherein the tongue is disposed between the first jaw and the second jaw.

38. The self-defense wearable of claim 36 wherein the at least one activating switch comprises a pressure activated activating switch.

39. The self-defense wearable of claim 31 further comprising a means for preventing the electrical charge from reaching the wearer through the inner surface of the body portion comprising an electrically insulative sub layer of electrically insulative material disposed proximal to the electrically conductive material such that it would be interposed between the electrically conductive material and the wearer's body during use.

40. The self-defense wearable of claim 31 wherein the means associated with the electrically conductive material for producing an electrical charge in electrical communication with the outer surface of the body portion includes a means for producing a visually exposed electric charge on the outer surface of the body portion.

41. The self-defense wearable of claim 40 wherein the means for producing an exposed electrical charge comprises first and second conductive terminals in electrical communication with the electrically conductive material wherein the first and second conductive terminals are separated by a given gap whereby an electric arc will be produced between the first and second conductive terminals when sufficient electrical power is provided to the electrically conductive material by the power source.

42. The self-defense wearable of claim 41 wherein the body portion is formed of at least two layers of material wherein one layer comprises a sub-layer and a second layer comprises an outer shell that overlies the sub-layer and wherein the sub-layer comprises a substrate with the first and second conductive terminals applied thereto.

43. The self-defense wearable of claim 42 wherein the first and second conductive terminals are incorporated into an electrically charged seam construction wherein the electrically charged seam construction includes a channel formed in the outer shell for exposing at least a portion of the gap between the first and second conductive terminals.

44. The self-defense wearable of claim 31 further comprising a means for preventing activation of the self-defense wearable depending on the sex of the wearer.

45. A self-defense wearable for providing a visually exposed electrical charge, the self-defense wearable comprising:

a body portion for overlying one or more body parts of a wearer wherein the body portion has an outer surface for being disposed distal to a wearer's body and an inner surface for being disposed proximal to a wearer's body and wherein the body portion is formed of at least one layer of material; and a means for producing a visually exposed electrical charge on the outer surface of the body portion comprising an electrically conductive material operably associated with at least a portion of the at least one layer of material, a power source for providing electrical power to the electrically conductive material wherein the power source is retained by the body portion, a means for inducing the self-defense wearable into a charged condition wherein the power source provides electrical power to the electrically conductive material to produce the exposed electrical charge, and a means for producing an electrical association between the electrically conductive material, the power source, and the at least one activating switch.

46. The self-defense wearable of claim 45 wherein the means for producing an exposed electrical charge comprises first and second conductive terminals in electrical communication with the electrically conductive material wherein the first and second conductive terminals are separated by a given gap whereby an electric arc will be produced between the first and second conductive terminals when sufficient electrical power is provided to the electrically conductive material by the power source.

47. The self-defense wearable of claim 46 wherein the body portion is formed of at least two layers of material wherein one layer comprises a sub-layer and a second layer comprises an outer shell that overlies the sub-layer and wherein the sub-layer comprises a substrate with the first and second conductive terminals applied thereto.

48. The self-defense wearable of claim 47 wherein the first and second conductive terminals are incorporated into an electrically charged seam construction wherein the electrically charged seam construction includes a channel formed in the outer shell for exposing at least a portion of the gap between the first and second conductive terminals.

49. The self-defense wearable of claim 46 wherein the first and second terminals are disposed generally parallel to one another over a given distance whereby a location of the electric arc between the first and second terminals will vary generally randomly.

* * * * *